United States Patent [19]

Korcz et al.

[11] Patent Number: 4,711,362

[45] Date of Patent: Dec. 8, 1987

[54] MODIFIED END CAP FOR THERMOPLASTIC CONTAINER

[75] Inventors: William H. Korcz, Houston, Tex.; Surendra N. Singhal, Tulsa, Okla.

[73] Assignee: Shell Oil Company, Houston, Tex.

[21] Appl. No.: 909,539

[22] Filed: Sep. 22, 1986

[51] Int. Cl.[4] ..... B65D 41/02

[52] U.S. Cl. ..... 220/67

[58] Field of Search ..... 220/319, 320, 359, 67; 215/232

[56] References Cited

U.S. PATENT DOCUMENTS 4,356,926 11/1982 Priestly et al. ..... 220/67

4,397,414 8/1983 Baldwin ..... 220/319 X

*Primary Examiner*—Donald F. Norton

*Attorney, Agent, or Firm*—Jennifer R. Daunis

[57] ABSTRACT

A modified end cap for a food or beverage thermoplastic container, which may be attached to a thermoplastic container sidewall without the necessity of flaring the thermoplastic sidewall of said container, which comprises: a suitable metallic end; and a metallic ring clip which is attached to the under portion of said end so that said ring clip can attach to the sidewalls of a thermoplastic container, the ring clip comprising: a first wall having a first edge and a second edge; a second wall having a first edge and a second edge, the second wall being positioned outside of and adjacent to the first wall; a third annular wall positioned substantially perpendicular to the first wall and the second wall, and having an inner and outer edge, where the inner edge is connected to the first edge of the first annular wall, and the outer edge is connected to the first edge of the second annular wall; a fourth annular wall having an inner and outer edge, where the inner edge is connected to the first edge of the second annular wall; and wherein the first and second annular walls are arranged concentric to a central longitudinal axis.

5 Claims, 3 Drawing Figures

FIG.1
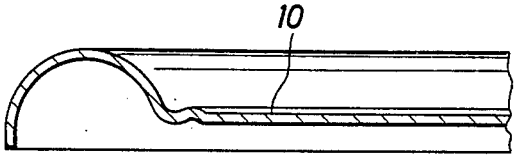
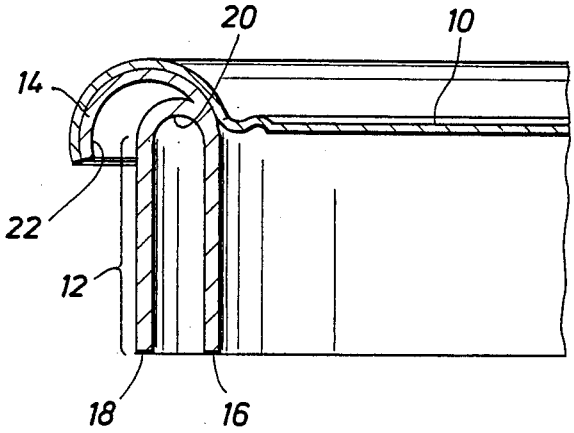
FIG. 2
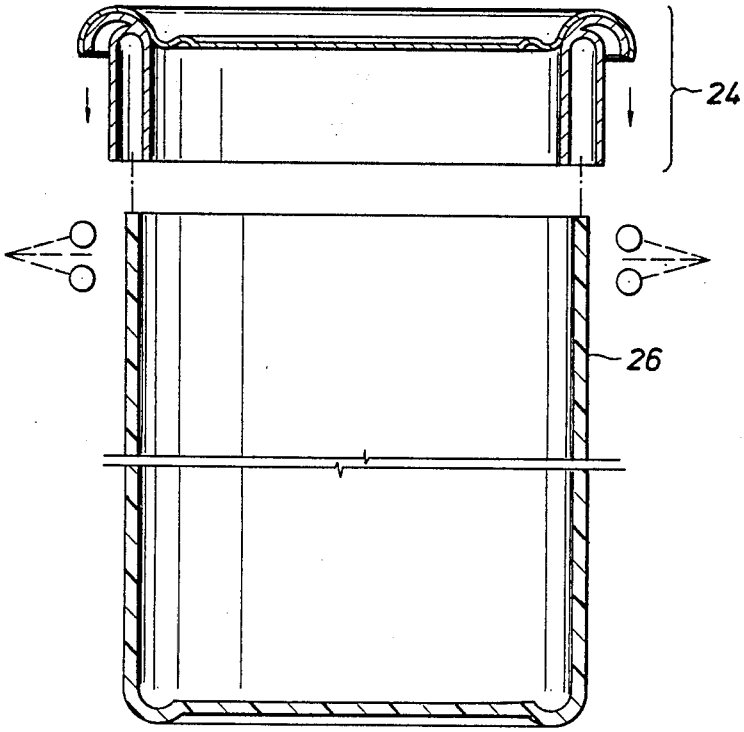
FIG. 3

MODIFIED END CAP FOR THERMOPLASTIC CONTAINER

BACKGROUND OF THE INVENTION

The present invention relates to a modified end cap for attachment to a food or beverage thermoplastic container. More particularly, an end cap which may be attached to a food or beverage thermoplastic container without the necessity of flaring the sidewall of the thermoplastic container.

Containers are made of many materials. Until recently, food and beverage containers in particular were often made of a metal such as aluminum. The sidewalls of the containers are made and then metal ends are attached to the metal sidewalls by some means, such as mechanical double seaming. In doing this, the metallic can sidewalls are flanged (flared or bent around the neck area) so that the ends may be double seamed.

Recently, the advent of plastic containers, such as plastic pressurized beverage containers, has posed new problems in attaching a metallic end to thermoplastic can bodies.

Flaring of the neck area of the sidewalls of plastic can bodies causes undesirable damage to the body and makes it difficult to fit and attach the conventional metallic lid onto the plastic body. Permanent flanges of uniform dimensions are also difficult for plastic can bodies owing to plastic memory of the sidewall.

SUMMARY OF THE INVENTION

A modified end cap for a food or beverage thermoplastic container, which may be attached to a thermoplastic container sidewall without the necessity of flaring the thermoplastic sidewall of said container, which comprises: a suitable metallic end; and a metallic ring clip which is attached to the under portion of said end so that said ring clip can attach to the sidewalls of a thermoplastic container, the ring clip comprising: a first wall having a first edge and a second edge; a second wall having a first edge and a second edge, the second wall being positioned outside of and adjacent to the first wall; a third annular wall positioned substantially perpendicular to the first wall and the second wall, and having an inner and outer edge, where the inner edge is connected to the first edge of the first annular wall, and the outer edge is connected to the first edge of the second annular wall; a fourth annular wall having an inner and outer edge of said fourth annular wall, where the inner edge is connected to the inner edge of the second annular wall; and wherein the first and second annular walls are arranged concentric to a central longitudinal axis.

BRIEF DESCRIPTION OF THE DRAWINGS

FIG. 1 shows a side view of a conventional end cap.

FIG. 2 shows a side half view of the modified end cap of the present invention.

FIG. 3 shows a side view of the modified end cap as it would be attached to the sidewalls of a thermoplastic container.

DETAILED DESCRIPTION OF THE INVENTION

A modified end cap for a food or beverage thermoplastic container which may be attached to a thermoplastic container sidewall has been invented, without having to flare the thermoplastic sidewall of the container, which is made up of a metallic ring clip attached to the under portion of the end so that the ring clip can attach to the sidewalls of a thermoplastic container. In this way, the body of the plastic can need not be flared, thus avoiding any damage to it but a simulated flared surface is provided by the metallic ring clip so that the end can be attached to the plastic sidewalls employing existing double seaming equipment.

FIG. 1 shows a side view of an end 10 used for beverage containers.

In FIG. 2, a side half view of the modified end cap of the present invention is shown. To metallic end 10 is attached a metallic ring clip 12 herein described at under portion 14 of said end 10. First annular ring 16 is surrounded by second annular ring 18 between which is a third annular ring 20. A fourth annular ring 22 is attached to the inner edge of said third annular ring 20. The rings are preferably annular walls.

FIG. 3 is a side view of the modified end cap 24 as it would be attached to the sidewalls 26 of a thermoplastic container.

The metallic ring clip 12 may be of several variations as long as it is attached to the under portion of end 10.

The annular walls or rings are formed so they provide a continuous metallic surface. This design allows the usage of a currently marketed metallic end without any alterations in its design.

The end clip 24 is designed so that the space between first ring 16 and second ring 18 is almost equal to the thickness of the sidewalls 26 of the thermoplastic container. This spacing is used to attach the straight neck of sidewalls 26 of the container to the end 10.

A resulting savings of process needed to flare the sidewalls 26 results.

Manufacturing of the modified end cap—The metallic ring clip may be manufactured separately and then bonded to the conventional metal end. Or, a new end may be stamped with contours, as shown in FIG. 2. The ring clip may be aluminum or steel or any suitable metal.

The ring clip should be substantially metal, for example, aluminum or steel. A continuous operation can provide a multitude of these rings at a very fast rate which could then be cut to desired length and directly fed to the end-seaming equipment.

FIG. 3 shows the sequence of events that take place in attaching the modified end cap to the sidewalls of the thermoplastic container. The sidewalls 26 are sprayed with an adhesive. The end cap 24 is then dropped or lowered over the thermoplastic sidewalls 26 will be squeezed through rollers to provide a structurally tight fit. The next sequence of squeezing operation will be the same as that in conventional double seaming. An automatic seaming tool may be designed to perform these operations at a desirable speed.

Other embodiments and variations of this invention will be apparent to one of ordinary skill in the art.

What is claimed:

1. A modified end cap for a food or beverage thermoplastic container, which may be attached to a thermoplastic container sidewall without the necessity of flaring the thermoplastic sidewall of said container, which comprises:

a suitable metallic end; and a metallic ring clip which is attached to the under portion of said end so that said ring clip can attach to the sidewalls of a thermoplastic container, said ring clip comprising:

a first wall having a first edge and a second edge;

a second wall having a first edge and a second edge, said second wall being positioned outside of and adjacent to said first wall;

a third annular wall positioned substantially perpendicular to said first wall and said second wall, and having an inner and outer edge, where said inner edge is connected to said first edge of said first annular wall, and said outer edge is connected to said first edge of said second annular wall;

a fourth annular wall having an inner and outer edge, where said inner edge of said fourth annular wall is connected to said inner edge of said third annular wall; and wherein said first and second annular walls are arranged concentric to a central longitudinal axis.

2. The end cap of claim 1, wherein said outer edge of said fourth annular wall is below a latitudinal axis, said axis being perpendicular to said second wall at said first edge of said second wall.

3. The end cap of claim 1, wherein said first wall forms a first annular ring defined about said central longitudinal axis and said second wall forms a second annular ring defined about said central longitudinal axis.

4. A modified end cap for a food or beverage thermoplastic container which may be attached to a thermoplastic container sidewall without the necessity of flaring the thermoplastic sidewall of said container, which comprises:

a suitable metallic end; and a metallic ring clip which is attached to the under portion of said end, so that said clip can attached to the sidewalls of a thermoplastic container, said ring clip comprising:

a first annular ring having a first edge and a second edge;

a second annular ring having a first edge and a second edge, said second wall being positioned outside of and adjacent to said first wall;

a third annular wall positioned substantially perpendicular to said first wall and said second wall, and having an inner and outer edge, where said inner edge is connected to said first edge of said first annular wall, and said outer edge is connected to said first edge of said second annular wall;

a fourth annular wall having an inner and outer edge, where said inner edge of said fourth annular wall is connected to said inner edge of said third annular wall; and wherein said first and second annular walls are arranged concentric to a central longitudinal axis.

5. The end cap of claim 4, wherein said outer edge of said fourth annular wall is below a latitudinal axis, said axis being perpendicular to said second annular ring at said first edge of said second annular ring.

* * * * *